US005173576A

United States Patent [19]

Feuling

[11] Patent Number: 5,173,576

[45] Date of Patent: Dec. 22, 1992

[54] MUFFLER FOR AN INTERNAL COMBUSTION ENGINE

[75] Inventor: James J. Feuling, Ventura, Calif.

[73] Assignee: Feuling Engineer, Inc., Ventura, Calif.

[21] Appl. No.: 633,557

[22] Filed: Dec. 24, 1990

[51] Int. Cl.[5] ..... F01N 1/00

[52] U.S. Cl. ..... 181/247; 181/249; 181/255

[58] Field of Search ..... 181/247, 249, 251, 255

[56] References Cited

U.S. PATENT DOCUMENTS

| | | | |
|---|---|---|---|
| 1,611,475 | 12/1926 | Maxim | 181/249 |
| 1,909,394 | 5/1933 | Dodge | 181/249 |
| 2,332,543 | 10/1943 | Wilson | 181/48 |
| 2,940,538 | 6/1960 | Billey | 181/63 |
| 4,671,381 | 6/1987 | Rascov | 181/255 |

*Primary Examiner*—L. T. Hix
*Assistant Examiner*—Eddie C. Lee
*Attorney, Agent, or Firm*—Frank D. Gilliam

[57] ABSTRACT

A muffler for an internal combustion engine or the like having improved attenuation, minimal back pressure and minimal effect to column inertia through the muffler. The muffler comprises an outer housing and a first perforated tube insert extending from one end of the housing and terminating within the muffler. In another embodiment the perforated first tube includes a second tube insert abutting the distal end of the first tube in a continuous flow relationship therewith. The second tube has a smaller diameter than the first tube and includes at least one enlarged portion between its ends. Other embodiments are shown that include a combination of either the first and second tubes alone, a second tube with a plurality of enlarged portions between its ends, different sized enlarged portions between the ends of the second tube, various configured enlarged portions and at least two different sized perforations through the perforated tubes. A bracket is shown for attaching the tubes within the housing.

18 Claims, 1 Drawing Sheet

MUFFLER FOR AN INTERNAL COMBUSTION ENGINE

BACKGROUND OF THE INVENTION

The invention relates in general to sound attenuation and, more specifically, to mufflers for use with internal combustion engines to reduce exhaust gas sound therefrom.

In many devices such as internal combustion engines, turbine engines, compressed gas powered tools, air handling systems, etc., considerable noise energy is generated and travels with the fluid or gasses. Such noise is objectionable and must be reduced prior to exit from a noisy device. A wide variety of "mufflers" and other sound attenuation devices have been developed and used.

Some mufflers use a plurality of baffles which radically change the path of the exhaust gas over a short distance. While such mufflers may be effective in reducing noise levels, they create undesirable high back pressure on the engines and reduce the column inertia of the exhaust gas flow, resulting in lower engine power and efficiency.

Other mufflers direct gasses straight through a perforated tube surrounded by sound absorbing material such as, glass fibers in the form of "glass wool" positioned between the tube and outer housing. These so called "glass-pack" mufflers generally produce low back pressure, are not satisfactory in reducing noise levels and lack long term durability.

Generally speaking, prior art mufflers have flow through resistance, produce acoustic wave reflection and cause a loss of column inertia.

Many attempts have been made to produce the ideal muffler. Some of these attempts can be found in the following U.S. Pat. Nos. 1,934,462; 1,922,848; 2,046,193; 2,826,261; 4,239,091; 4,632,216; 4,671,381; 4,674,594 and 4,690,245 and others. None of these prior art mufflers have reached an ultimate of sufficient reducing sound while maintaining column inertia with minimum flow loss.

Also some of these prior art mufflers are complex to manufacture, heavy in weight and overly large for the purpose intended and others have a short life due to corrosion or are susceptible to burn out from the heat of the gasses passing therethrough.

Applicant's prior U.S. Pat. Nos. 4,263,982 and 4,834,214 have considerably advanced the muffler art.

There is, however, a continuing need to further improve the sound attenuation to further reduce noise pollution. The muffler of the present invention advances the current state of the muffler art in this area of desired improvement.

SUMMARY OF THE INVENTION

Problems that exist in even the most improved mufflers are further reduced by the introduction of the muffler of the present invention and the various embodiments thereof.

The present improved muffler includes an embodiment that consists of a hollow housing with an insert comprising a first hollow perforated tube and an abutting second hollow, perforate tube with a series of enlarged or expanded areas having the same or different sized enlarged areas along the second perforated elongated tube. The second hollow elongated tube has a diameter smaller than the diameter of the first hollow tube is positioned at the distal end of the first hollow tube in an inline flow through relationship. The perforations in the first and second tubes provide a open area through the tubes in the range of 40 to 60%.

In another embodiment of the invention the second perforated elongated tube with the protrusions is employed alone without the first tube.

The different sized enlarged areas along the second tube can be of various different configurations as for example, curvilinear, rectilinear, in the shape of spheres, cubes, triangular, etc. to provide various different effects to the sounds and gas flow through the device.

An object of the present invention is to provide a sound attenuation device for an internal combustion engine which reduces the noise produced therefrom which travels in the exhaust gas stream, maintains the column inertia of that gas stream and provides little or low back pressure to the engine.

It is another object of this invention to produce an internal combustion muffler that comprises a minimum of components and those components can be stamped or forged.

It is yet another object of this invention to produce a muffler that has a minimal sized profile that can be utilized in confined areas of a modern vehicle.

Still another object of this invention is to provide a more efficient muffler that is low in economic cost and has a long expected life.

Yet another object of the muffler of this invention is to provide a low noise muffler that can be used in series with or at the distal end of an engine exhaust system.

Other advantages and features of the invention will become apparent from the following description of several embodiments thereof, shown in the attached drawing FIGS., in which:

BRIEF DESCRIPTION OF THE DRAWING FIGURES

DETAILED DESCRIPTION OF THE PREFERRED EMBODIMENT

Figure 1:
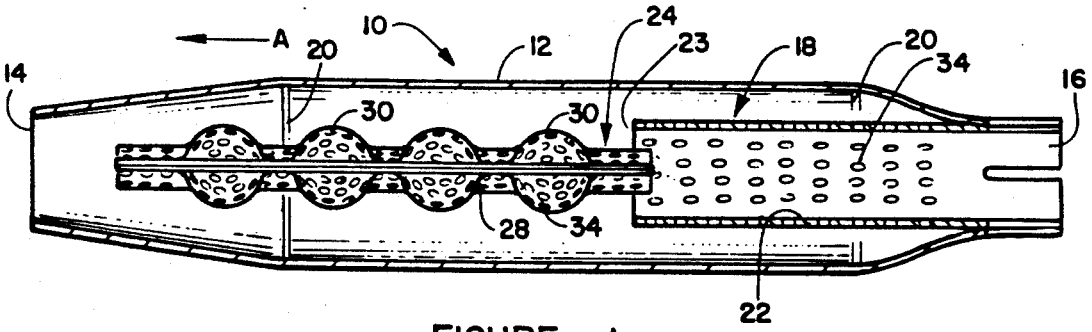
FIG. 1 depicts a cutaway showing of one embodiment of the muffler of the present invention.
Figure 2:
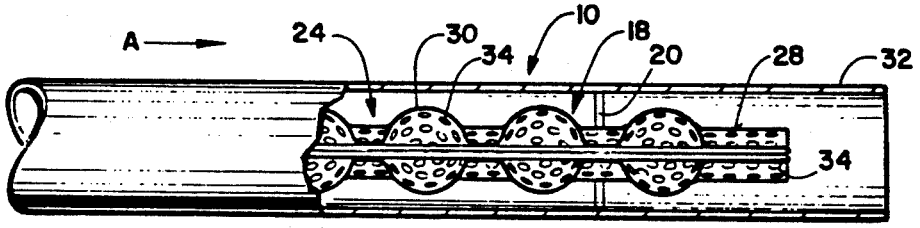
FIG. 2 depicts a partial cutaway showing of a second embodiment of the muffler of the present invention.
Figure 3:
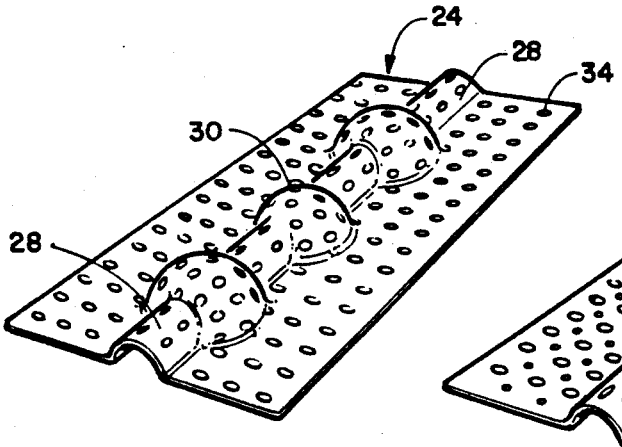
FIG. 3 depicts a perspective showing utilizing only the other one half of the insert shown FIG. 1.
Figure 4:
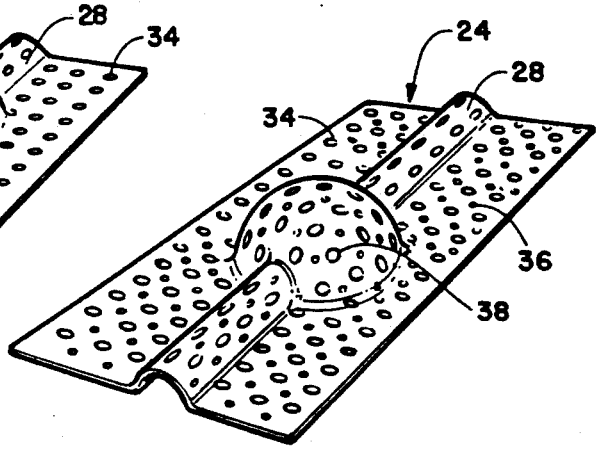
FIG. 4 depicts a perspective showing utilizing only the other one half of the insert having a single bulbus enlarged portion for use in either the housing of FIG. 1 or FIG. 2.
Figure 5:
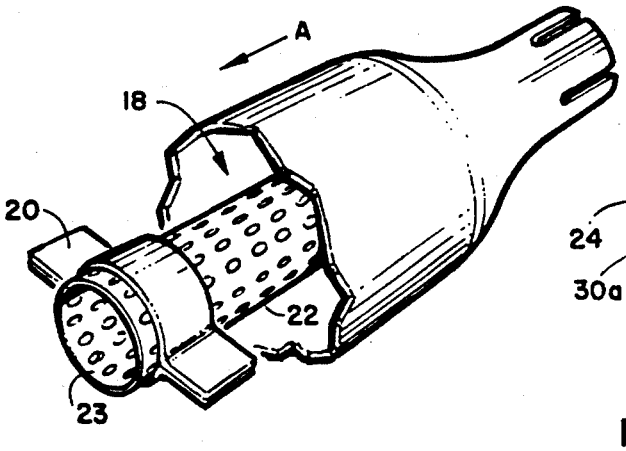
FIG. 5 depicts a partial cutaway showing of a muffler of invention using only the tubular portion of the embodiment of FIGS. 1 or 2.
Figure 6:
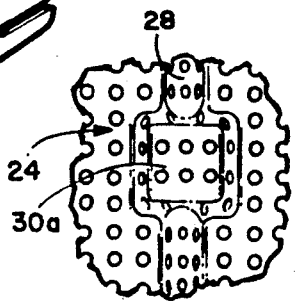
FIG. 6 depicts another embodiment of the bulbus portion of the muffler insert of the invention.
Figure 7:
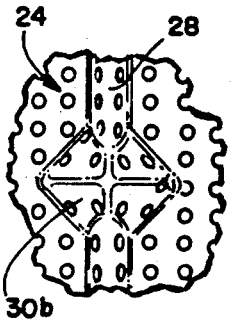
FIG. 7 depicts yet another embodiment of the bulbus portion of the muffler insert of the invention.

FIG. 1 depicts a cutaway showing of the muffler of the present invention, FIG. 2 depicts a partial cutaway showing of a second embodiment of the invention, FIG. 3 depicts a first embodiment of the muffler's acoustic insert, FIG. 4 depicts a second embodiment of the acoustic insert configuration, FIG. 5 depicts a section of the muffler of the invention depicting a third embodiment of the acoustic insert showing the centering bracket for maintaining the muffler acoustic insert in position, FIG. 6 is a third embodiment of the acoustic material and FIG. 7 is a fourth embodiment of the acoustic insert.

Referring now to FIG. 1. The muffler 10 of a first embodiment of the invention is generally designed for use at the distal end of an engine exhaust system such as, for example, on a motorcycle. This embodiment has an outer shell 12 tapered at both ends. Shell ends 14 and 16 are tapered from a larger diameter of the central shell portion to a smaller diameter in a direction toward the down stream end 14 and upstream end 16. Downstream end 14 is shown with a linear rectilinear reduction toward the down stream end and upstream end 16 has a slightly curvilinear transition between the larger diameter of the shell and the smaller diameter upstream end. The translation from the larger diameter of the shell and the upstream end 16 is shown shorter than the length of the translation between the larger diameter of the shell and the down stream end 14, this feature is not intended to be limiting but merely shown to be representative for the purpose of explanation. If this embodiment of the muffler of the present invention is to be utilized other than at the distal end of an exhaust system as depicted the tapered ends could be the same, take either configuration or different configurations so long as the muffler can be attach in series with a tail pipe or the like of a conventional engine exhaust system.

A center body 18 having a diameter less than the diameter of the body portion 12 is dimensioned relative to the down stream and upstream ends 14 and 16 to be insertable into either end prior to the diameter reduction forming of the insertable end as shown in the various drawing FIGURES and is secured within the muffler shell 12 by means of centering support brackets 20 one of which is clearly shown in the various drawing FIGURES. The support brackets are attached to the body portion of the muffler by spot welding from the exterior or other conventional attaching means known in this art. The insertable end is then formed to a smaller dimension as shown in the drawings.

The insert 18 of the muffler is configured with a first perforated tube 22 positioned at one end thereof with a second perforated tube 24 attached to or merely abutted against the inner end 23 of perforated tube 22 by means of a similar bracket 20 which is open to allow gas flow therethrough. Second tube 24 includes a through tube portion 28 having a diameter smaller that the general diameter of the first tube 22 and a plurality of spaced apart enlarged portions 30 shown as perforated walled in the approximate shape of spheres. The enlarged portions 30 can take many different forms as can be seen in the various other drawing FIGURES.

The direction of gas flow through the muffler of the invention is shown in the various drawing FIGURES by the Arrow A. The gas input and output gas pressures remain substantially the same with a noticeable reduction of combustion noise levels in the gases exiting the muffler relative to the noise levels of the gases entering the muffler. The column inertia is not noticeably effected by the gas flow through the muffler.

In drawing FIG. 2 a second embodiment of the muffler of the invention is shown. In this embodiment, the center body 18 is merely slipped into one end of a uniform dimensioned pipe 32. The pipe 32 comprising an exhaust system tail pipe or the like. The attachment of this embodiment to the inside of pipe 32 is as described above. In this embodiment only the second tube 24 is utilized to form the center body 18.

FIG. 3 depicts a one half portion of the embodiment of the insert 18 as used in the embodiment of drawing FIG. 2, without the first perforated tube attached. It should be understood that two of the showings of this FIGURE and two of the showings of drawing FIG. 4 are welded together to form the second tube 24. The perforations 34 and 36 of this embodiment are shown to be of two different diameters. Multiple different perforation of different diameters may be desirable for reduction of certain different sound frequencies.

FIG. 4 is yet another embodiment of the second tube 24 showing only one greatly enlarged area 38 along the length of the second tube 24. The enlarged area 38 is greater in size than the enlarged area 30 of the other drawing FIGURES.

FIG. 5 depicts a portion of an embodiment of the present invention in partial cutaway. In this embodiment, only the first tube 22 is utilized in the muffler construction.

FIGS. 6 and 7 depict different embodiments of the enlarged portions 30*a* and 30*b* of second tube 24.

As shown in drawing FIG. 1, the exhaust gas from an internal combustion engine flows into the muffler 10 along arrow A then flows through the first perforated tube 22. This gas entering the muffler passes through the perforated walls of the tube, out the end 23 thereof into the main body portion 12 and through second tube 24 where it passes through the perforated walls of the smaller tube and enlarged portions and out the distal end thereof. The gas paths through the muffler are combined at the output end of the muffler. There is sufficient open area for the gas to have substantially the same pressure at he input and output and for the column inertia to be substantially maintained through the muffler. The various tortuous paths presented to the sound waves within the muffler absorb or dampen a substantial amount of the sound accompanying the gas flow into the muffler thereby reducing the sound leaving the muffler with the continual gas flow.

While certain specific proportions, materials and arrangements have been detailed in the above description of the preferred embodiments of the invention, these may be varied, where suitable, with similar results. For Example, the muffler components may be formed from any suitable materials of construction, such as, for example and not by way of limitation, steel, aluminum, reinforced plastic etc. and may be manufactured by stamping, hydro forming, rolling, cold forming, etc.

Other variations, ramifications and applications of this invention will occur to those skilled in the art upon reading the present disclosure. These are intended to be included within the scope of this invention or defined in the appended claims.

What is claimed is:

1. An improved sound attenuation device having an input and an output end comprising:
   - a hollow body portion;
   - a first perforated tube open at each end extending from said input end to a position intermediate the input and output ends; and
   - means positioned within said hollow body portion and spaced from said input end thereof for supporting said first perforated tube within said hollow body housing.

2. The attenuation device as defined in claim 1 further comprising a second perforated tube, said first and second perforated tube having substantially the same longitudinal center line and the diameter of said second perforated tube being smaller than the diameter of said first perforated tube.

3. The sound attenuation device of claim 2 wherein said second perforated tube is formed from two attached symmetrical plates, one of said plates is rotated 180 degrees to the other one of said plates.

4. The attenuation device of claim 2 wherein said second perforated tube comprises at least one enlarged area along the length of said second perforated tube.

5. The attenuation device of claim 2 wherein said second perforated tube has a plurality of spaced apart enlarged areas along the length of said second perforated tube.

6. The attenuation device of claim 5 wherein said plurality of enlarged areas have at least two different sized cross-sections.

7. The attenuation device of claim 1 wherein said first perforated tube has perforations of at least two different diameters.

8. The attenuation device of claim 2 wherein said second perforated tube is perforated by at least two different sized perforations.

9. The attenuation device of claim 4 wherein said at least one area is curvilinear in cross-section.

10. The attenuation device of claim 9 wherein said curvilinear cross-section configurations are approximate spheres.

11. The attenuation device of claim 4 wherein said at least one enlarged area is rectilinear in cross-section.

12. The attenuation device of claim 11 wherein said rectilinear cross-section configurations are triangular.

13. The attenuation device of claim 11 wherein said rectilinear cross-section configurations are a plurality of triangles.

14. The attenuation device of claim 1 wherein said means for supporting said first perforated tube comprises a bracket.

15. An improved sound attenuation device having an input and an output end comprising:

a hollow body portion;

a perforated tube having open ends extending from said a perforated tube having open ends extending from said input end to a position intermediate the input and output ends, said tube having at least one area of increased dimension therealong; and means positioned within said hollow body portion and spaced from said input end thereof for supporting said perforated tube within said hollow body housing.

16. The attenuation device of claim 15 wherein said at least one area of increased dimension comprises a plurality of spaced apart areas of increased dimension.

17. The attenuation device of claim 16 wherein said plurality of spaced apart areas of increased dimension comprise at least two different sized areas.

18. The attenuation device of claim 15 wherein the perforations in said tube have at least two different diameters.

* * * * *